US005247563A

United States Patent [19]

Block et al.

[11] Patent Number: 5,247,563

[45] Date of Patent: Sep. 21, 1993

[54] HIGH VAPOR PRESSURE METAL FOR X-RAY ANODE BRAZE JOINT

[75] Inventors: Wayne F. Block, Sussex; John A. Holma, Greenfield, both of Wis.

[73] Assignee: General Electric Company, Milwaukee, Wis.

[21] Appl. No.: 841,921

[22] Filed: Feb. 25, 1992

[51] Int. Cl.[5] ..... H01J 35/10

[52] U.S. Cl. ..... 378/144; 378/127; 228/239; 228/124; 228/263.12

[58] Field of Search ..... 378/144, 143, 125, 127, 378/121; 228/124, 239, 263.12

[56] References Cited

U.S. PATENT DOCUMENTS

| | | | |
|---|---|---|---|
| 4,736,400 | 4/1988 | Koller et al. | 378/125 |
| 4,847,883 | 7/1989 | Fourre | 378/144 |
| 4,958,364 | 9/1990 | Guerin et al. | 378/144 |
| 5,008,918 | 4/1991 | Lee et al. | 378/144 |
| 5,178,316 | 1/1993 | Block | 228/124 |

*Primary Examiner*—David P. Porta
*Assistant Examiner*—Kim-Kwok Chu
*Attorney, Agent, or Firm*—Quarles & Brady

[57] ABSTRACT

A method of bonding a metallic target layer and a graphite disk to provide a composite rotating X-ray tube target wherein a high vapor pressure metal is placed between the target layer and the graphite disk and the vapor pressure of the joint is controlled. The vapor pressure is controlled by limiting the thickness of the joint and thereby causing the metallic character of the braze joint in this region to be altered. In a preferred manner, this is effected by interfitting projecting and recessed portions in the graphite disk and metallic target layer. The preferred high vapor pressure metal is titanium. A composite X-ray tube target is produced having a high remelt temperature and thus capable of being employed in X-ray tubes having more aggressive protocols.

10 Claims, 2 Drawing Sheets

HIGH VAPOR PRESSURE METAL FOR X-RAY ANODE BRAZE JOINT

BACKGROUND OF THE INVENTION

This invention relates to the joining of an X-ray tube target assembly. More particularly, it relates to the joining of the graphite disk to the metallic layer portion wherein titanium, or its alloys are used as the brazing material and the vapor pressure of the joint is controlled.

In producing new and improved targets for rotary anode X-ray application, it would be desirable to have the anode operate at or above a braze joint temperature of 1375° C. Presently, platinum brazed anodes operate at temperatures closer to 1300° C. These targets are braze joint limited, and if the operating temperature could be made higher, then these tubes could run more aggressive protocols. Recently employed X-ray tubes are projected to run at about 1400° C. in accordance with their more aggressive protocol.

It is known from a strength standpoint, that a titanium braze can withstand cap warpage up to 1800° C. under isothermal heating conditions. Cap warpage is caused by the difference in the coefficients of thermal expansion between the molybdenum substrate and the tungsten focal tract causing the molybdenum substrate to depress at the top and expand at the bottom. However, based on physical property data, the sublimation of the titanium braze joint should become significant at braze joint temperatures greater than 1375° C. In the tube, therefore, the braze joint could contribute to high voltage instability if the target should operate at temperatures above 1375° C. The prior art does not provide a solution to the sublimation problem.

It is, therefore, an object of the present invention to provide an improved composite X-ray target with a brazed interconnection having improved bond strength and with higher operating temperature characteristics. Another object of the present invention is to provide an improved method of brazing composite X-ray tube targets. Yet another object of the present invention is to provide an improved method of the foregoing type wherein the vapor pressure of the braze joint metal is controlled.

These objects and other features and advantages will become more readily apparent upon reference to the following description when taken in conjunction with the appended drawings.

SUMMARY OF THE INVENTION

Briefly, in accordance with one aspect of the present invention, there is provided a method of bonding a metallic target layer and a graphite disk to result in a composite rotating X-ray tube target. The target layer and graphite disk are joined by a heated high vapor pressure metal layer to effect a braze joint, the vapor pressure of which is controlled by effecting a change in the character of the braze metal at the critical surface braze joint regions or locations in the joint.

According to various aspects of the invention, the metallic target includes a braze joint alloyed with molybdenum and carbon which alloys are formed in situ at the time the braze layer is formed. In one embodiment, the metallic target layer is joined to the graphite disk by a braze joint having interfitting projecting and recessed portions in the graphite disk and metallic target layer. In one specific aspect, the metallic disk has an annular projecting section, and the graphite disk has a complementary relieved section for receiving the annular projecting section.

In the drawings as hereinafter described, preferred embodiments are depicted. However, various other modifications and alternative constructions can be made thereto without departing from the true spirit and scope of the invention.

DESCRIPTION OF THE PRIOR ART

Figure 1:
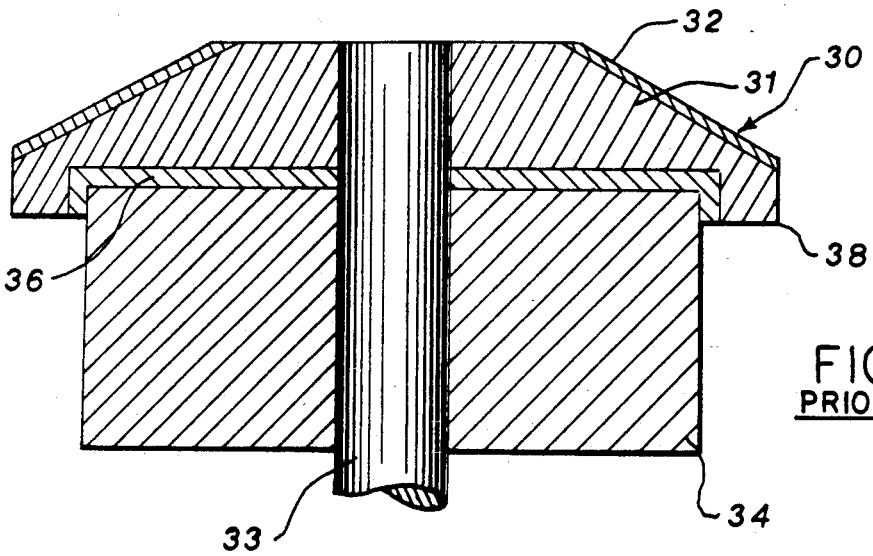
FIG. 1 PRIOR ART
FIG. 1 is a sectional view of an X-ray target made in accordance with the prior art.

Referring to FIG. 1, there is shown a typical target, or anode assembly generally 30, for use in a rotating anode X-ray tube. The assembly 30 includes the usual metal disk portion 31 having a focal tract 32 applied to a forward face thereof for producing X-rays when bombarded by the electrons from a cathode in a conventional manner. The disk 31 is composed of a suitable refractory metal such as molybdenum or molybdenum alloy such as TZM. The conventional focal track 32 disposed therein is composed of a tungsten or a tungsten/rhenium alloy material. The disk 31 is attached to a stem 33 by a conventional method, such as by brazing, diffusion bonding or mechanical attachment.

Attached to a rear face of the metal disk 31 is a graphite disk portion 34, the attachment being made by a titanium braze, indicated at 36. The primary purpose of the graphite disk 34 is to provide a heat sink for the heat which is transferred through the metal disk 31 from the focal track 32. It is best if the heat-sink function can be provided without contributing significantly to the mass of the target assembly. A flange portion 38 extends over an outer section of the graphite disk 34 with the braze joint 36 extending between the metal disk 31 and the graphite disk 34 in a uniform and L-shaped manner.

DESCRIPTION OF THE PREFERRED EMBODIMENT

Figure 2:
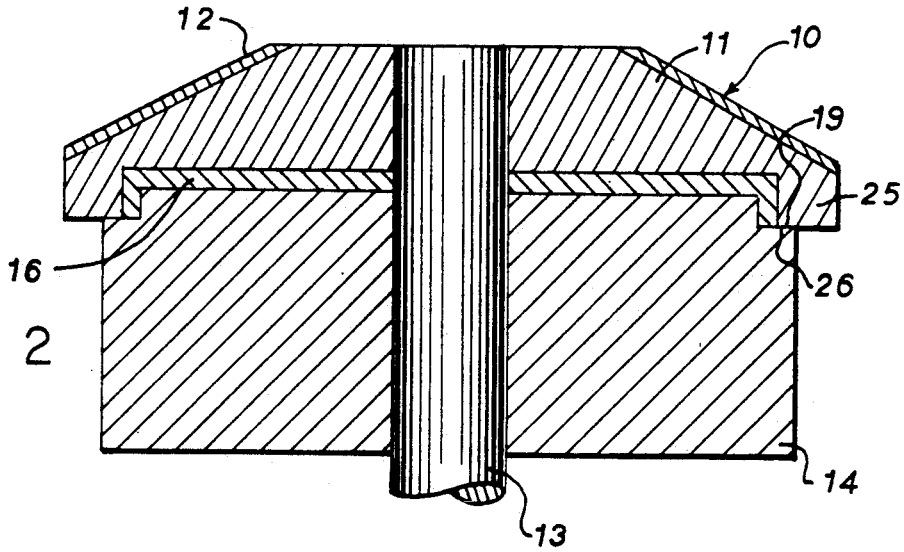
FIG. 2 is a view similar to FIG. 1 of an X-ray target made in accordance with the invention.

Referring now to FIG. 2, there is shown a target, or anode assembly generally 10, for use as a rotating anode X-ray tube in accordance with the invention. The assembly 10 has the same components as previously described for assembly 30. There is the metal disk portion 11 or metallic target layer having a focal tract 12 with the metal disk portion 11 being attached to a stem 13. The metal disk 11 is attached to a graphite disk portion 14 by the braze joint indicated at 16. All of the components are composed of the same materials which are attached in the same manner as described in conjunction with assembly 30.

The difference between the assembly 10 and 30 is in the braze titanium joint 16 as represented by the interfitting of the metal disk portion 11 and the graphite disk 14. Not only does disk portion 11 have an annular flange 25 which extends over an outer section of the graphite disk portion 14, but graphite disk 14 has a complementary relieved section 26 which receives a portion of the flange 25. The resulting reduced portion of the braze joint 16 is indicated by the numeral 19 and has a thickness no greater than 2 mils. It is an important difference between assembly 10 and 30 as it is by this means that the braze joint vapor pressure is controlled by limiting the thickness of the joint 16 and thus changing the metallic properties of the braze joint in this critical region by forming titanium carbide and an alloy with molybdenum as well as a seal at the outer diameter of the assembly 10 as represented by the numeral 19.

Figure 3:
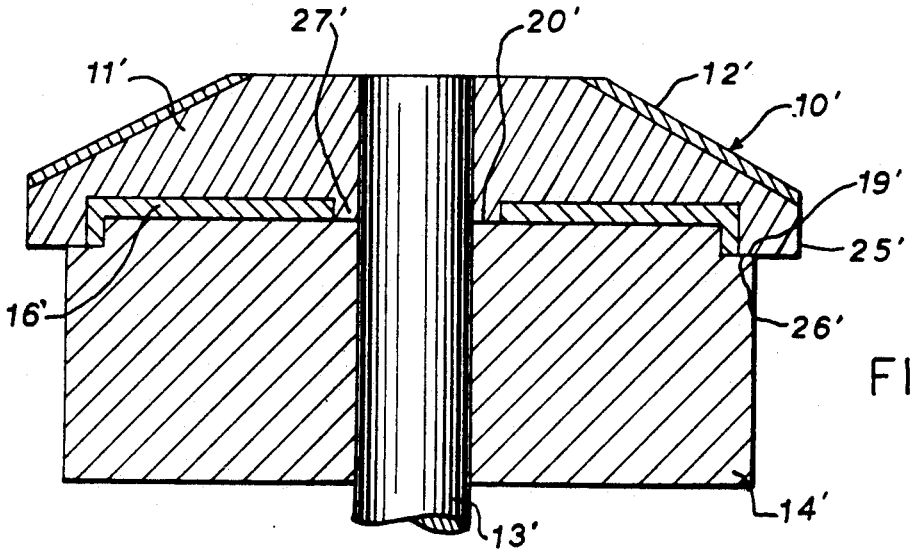
FIG. 3 is a view similar to FIG. 1 showing another embodiment.

FIG. 3 represents an alternative embodiment generally 10' where similar components are referred to by similar numbers except they are primed. The difference between embodiment 10' and 10 is in the braze joint 16' having a second reduced cross-sectional portion at 20'. This is at the inner diameter of the graphite disk 14' and is formed by not relieving graphite disk 14' in this area. This effects a reduction in the cross-section of the braze joint 16' adjacent stem 13' and therefore produces the desired change in the properties of the braze joint in this region. It has been found that while it may be advantageous to have two reduced sections 19' and 20', it is not essential as the outer diameter portion of the anode assembly 10' runs hotter than the inside diameter portion as represented by the connection with the stem 13.

Figure 4:
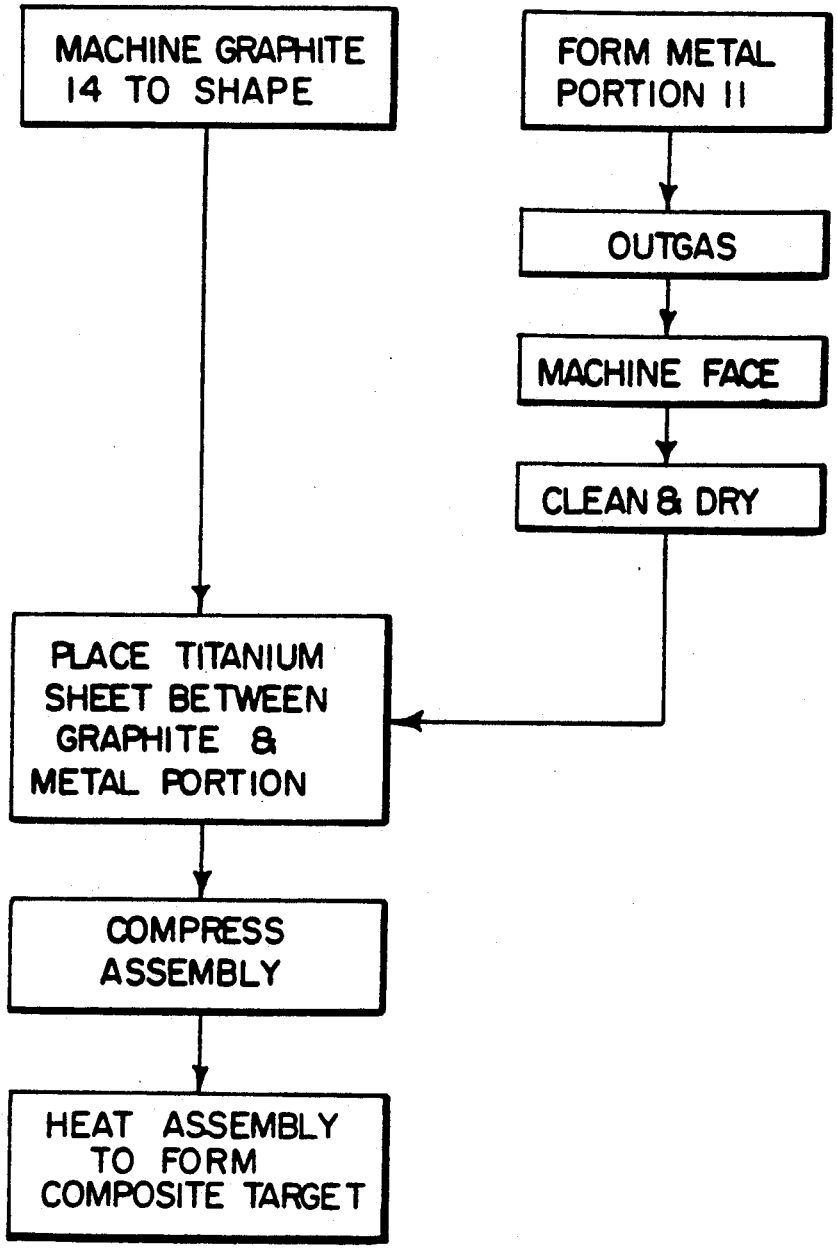
FIG. 4 is a flow diagram showing a process of target fabrication in accordance with the invention.

The specific process to achieve this improved braze joint is described in the flow diagram of FIG. 4. All of the steps are standard except with respect to the forming of the relived sections, 26 and 26' is graphite disk 14 and 14', respectively, and not relieving metal disk portion 11' in the area indicated by numeral 27'. As indicated in the diagram, a sheet of titanium is placed between the TZM disk portions 11 or 11' and the graphite disks 14 or 14'. The sheet has a thickness of approximately 9 mils. The assemblies 10 and 10' are compressed and placed in a vacuum chamber furnace which is pulled to a vacuum of about $10^{-5}$ torr. While standard furnace conditions can be employed in brazing the assemblies 10 and 10', preferred conditions are those described in commonly assigned, copending application entitled "Brazed X-Ray Tube Anode" Ser. No. 07/832,271 filed Feb. 7, 1992 wherein the assembly is heated to 1550° C. and held for 30 minutes. Heat is rapidly applied at the rate of about 20° C./min. through the critical temperature region which is the temperature zone between the carbon-braze material eutectic temperature and the braze metal melt temperature. Heating of the assembly is continued until a temperature of 1750° C. is reached which is approximately 75° C. above the melt temperature of the braze metal. This temperature is held for approximately 5 minutes. After this holding period, the assembly is cooled rapidly at the rate of about 50° C./min. back through the critical carbon eutectic temperature-braze metal melt temperature region.

Brazed coupons exhibiting either the normal braze joint of assembly 30 or the modified version of assembly 10' were vacuum fired at 1400° C. and $1\times10^{-7}$ torr. Their weight was measured before and after each furnace run It was found that the normal titanium braze joint lost weight at a rate of $67\times10^{-10}$ grams/cm hr of exposed brazed length. The coupon with the modified braze joint of assembly 10' lost weight at a rate of $6\times10^{-10}$ grams/cm.hr of braze length. Based on a simple reduction in cross-sectional area, the vaporization rate should only have decreased to $17\times10^{-10}$ grams/cm.hr. This indicates that some other mechanism is at work in reducing the vapor pressure of the titanium braze joint.

There are several possible explanations for this phenomenon. One is due to the reduced thickness at the surface region as the titanium carbide layer takes up a much greater percentage of the surface area of the joint. Since titanium carbide has a lower vapor pressure than titanium, the tendency for sublimation is reduced. Another explanation is the extensive alloying that occurs between titanium and molybdenum in these critical regions of the braze joint. Since the thickness is reduced, the extent of alloying with molybdenum is increased in the surface braze joint regions. Similar to titanium carbide, molybdenum has a lower vapor pressure than titanium Extensive alloying with molybdenum should then decrease the tendency for the braze joint to sublime. Finally, a third explanation was seen in two micrographs of the braze joint. In the micrograph of the normal braze joint there was shown severe etching of the grain boundaries. It is known that atoms in this area of a metal are at a higher energy state and would be more likely to sublime. However, in the micrograph of the joint 16' of this invention, there is a distinct absence of this grain boundary etching. The reduced joint thickness has apparently either eliminated grain boundary formation or made it impervious to vaporization at 1400° C. and $1\times10^{-7}$ torr due to the increased alloying with the molybdenum substrate.

There are other possible approaches to alleviating this problem, but investigations have not verified this. One is to form a continuous skin of TiC at the exposed surface of the braze joint. This can be done by heating in a carbonaceous atmosphere at an elevated temperature. An attempt was made to do this, but only a discontinuous TiC layer was formed. Vaporization was still significant for this braze joint. Another approach is to deposit a continuous layer of a low vapor pressure metal over the top of the exposed titanium braze joint. An attempt was made with molybdenum and to deposit it by sputtering. Again, this process was only partially successful. Apparently the Mo layer had cracks in it which allowed the titanium to vaporize underneath the Mo layer.

While this invention has been described with reference to particular embodiments, other modifications and variations will appear to those skilled in the art in view of the above teachings. For example, while a specific interfitting braze joint has been described herein, other interfitting structures of various geometric configurations could be employed such as curved or rounded configurations. Further, titanium is utilized as the metal of choice. However, any other metals having high vapor pressure tendencies could be advantageously employed such as vanadium as well as titanium and vanadium alloyed together or with columbium, hafnium, and zirconium. Accordingly, it should be understood that within the scope of the appended claims, the invention may be practiced otherwise than is specifically described.

By the term "high vapor pressure metal", is meant a metal which tends to sublime or gasify at higher pressures below atmosphere than another metal which would tend to sublime at lower pressures below atmosphere.

We claim:

1. A method of bonding a metallic target layer and a graphite disk to provide a composite rotating x-ray target comprising:

joining said target layer and said graphite disk with a heated high vapor pressure metal layer to effect a braze joint; and forming a seal at a periphery of said target layer and said graphite disk to control the vapor pressure of said joint at surface braze joint regions, said seal providing a barrier between an outer vacuum atmosphere and said braze joint.

2. The method of claim 1 wherein said seal is effected by limiting the thickness of said braze joint.

3. The method of claim 1 wherein said high vapor pressure metal is titanium or a titanium alloy and titanium carbide is formed in situ at the time the titanium layer is formed to effect said titanium joint.

4. The method of claim 1 wherein said surface braze joint regions are alloyed with molybdenum.

5. An improved rotating x-ray target comprising:

a graphite disk;

a metallic target layer jointed to said graphite disk by a braze joint, said joint defined by an interfitting projecting and recessed portion, said projecting and recessed portion located at a periphery of said graphite disk and metallic target layer to provide a seal between said graphite disk and said metallic target layer, said seal providing a barrier between an outer vacuum atmosphere and said braze joint; and a brazing metal filling said joint.

6. The improvement of claim 5 wherein said brazing metal is a metal with high vapor pressure tendencies.

7. The improvement of claim 6 wherein said high vapor pressure metal is titanium or vanadium or alloys thereof.

8. The improvement of claim 7 wherein said brazing metal is titanium or an alloy thereof.

9. The improvement of claim 5 wherein said braze joint is defined by said metallic disk having an annular projecting section and said graphite disk has a complementary relieved section for receiving a portion of said annular projecting section.

10. The improvement of claim 9 wherein said interfitting joint is further defined by a reduction in the cross-section of the braze joint adjacent a connection with a stem.

* * * * *

UNITED STATES PATENT AND TRADEMARK OFFICE

CERTIFICATE OF CORRECTION

PATENT NO. : 5,247,563

DATED : September 21, 1993

INVENTOR(S) : Wayne F. Block and John A. Holma

It is certified that error appears in the above-identified patent and that said Letters Patent is hereby corrected as shown below:

| | |
|---|---|
| Column 1, lines 20 and 23 | after "C" the "." should be deleted. |
| Column 1, line 63 | before "at the time" "in situ" should be underscored. |
| Column 3, line 28 | before "sections" "relived" should be --relieved--. |
| Column 3, line 28 | after "26'" "is" should be --in--. |
| Column 3, lines 42, 43 and 48 (2 times) | after "C" the "." should be deleted. |
| Column 3, line 52 | after "C" the "." should be deleted. |
| Column 3, line 57 | after "C" the "." should be deleted. |
| Column 3, line 59 | after "run" a --.-- should be added. |
| Column 3, line 60 | after "cm" a --.-- should be added. |
| Column 4, line 13 | after "titanium" a --.-- should be added. |
| Column 4, line 26 | after "C" the "." should be deleted. |
| Col. 5, claim 3, line 13 | before "at the time" "in situ" should be underscored. |

UNITED STATES PATENT AND TRADEMARK OFFICE

CERTIFICATE OF CORRECTION

PATENT NO. : 5,247,563 Page 2 of 2

DATED : Sept. 21, 1993

INVENTOR(S) : Wayne F. Block and John A. Holma

It is certified that error appears in the above-indentified patent and that said Letters Patent is hereby corrected as shown below:

Col. 5, line 19, after, layer "jointed" should be --joined--

Signed and Sealed this

Twelfth Day of April, 1994

*Attest:*

Bruce Lehman

BRUCE LEHMAN

*Attesting Officer*

*Commissioner of Patents and Trademarks*